US006129034A

United States Patent [19]

Santa Cruz et al.

[11] Patent Number: 6,129,034

[45] Date of Patent: Oct. 10, 2000

[54] ACCESSORY COVER FOR A BOAT

[76] Inventors: Cathy D. Santa Cruz, 401 Canyon Way, #43, Sparks, Nev. 89434; Frank L. Davis, 6 E. Lenwood Dr., Sparks, Nev. 89431; William L. Retzer, 8555 Bella Oaks Dr., Sparks, Nev. 89434

[21] Appl. No.: 09/156,239

[22] Filed: Sep. 18, 1998

[51] Int. Cl.[7] ..... B63B 17/00

[52] U.S. Cl. ..... 114/361

[58] Field of Search ..... 114/361, 364

[56] References Cited

U.S. PATENT DOCUMENTS

| | | | |
|---|---|---|---|
| 2,732,877 | 1/1956 | Taylor | 114/361 |
| 2,864,391 | 12/1958 | Stark | 114/361 |
| 3,698,409 | 10/1972 | Koontz et al. | 114/361 |
| 3,810,266 | 5/1974 | Iller | 114/361 |
| 4,075,723 | 2/1978 | Bareis et al. | 114/361 |
| 4,300,253 | 11/1981 | Anderson | 114/361 |
| 4,671,203 | 6/1987 | Sanburg | 114/361 |
| 5,303,667 | 4/1994 | Zirkelbach et al. | 114/361 |
| 5,333,634 | 8/1994 | Taylor | 135/98 |
| 5,343,824 | 9/1994 | Floyd | 114/361 |
| 5,394,821 | 3/1995 | Ziegler et al. | 114/219 |
| 5,396,861 | 3/1995 | Acker et al. | 114/361 |
| 5,458,079 | 10/1995 | Matthews et al. | 114/351 |
| 5,479,872 | 1/1996 | Hulett | 114/360 |
| 5,564,358 | 10/1996 | Newton | 114/361 |
| 5,887,539 | 3/1999 | Rex et al. | 114/351 |
| 5,927,311 | 7/1999 | Jager | 135/124 |

*Primary Examiner*—S. Joseph Morano
*Assistant Examiner*—Andrew D. Wright

[57] ABSTRACT

Herein taught is an accessory cover device which is removably attachable to an open-top boat. With the cover being of a size and shape to provide comfortable shelter for the user. Also, the cover is portable, and easily assembled and secured while the user is in the boat.

1 Claim, 9 Drawing Sheets

FIG. 8
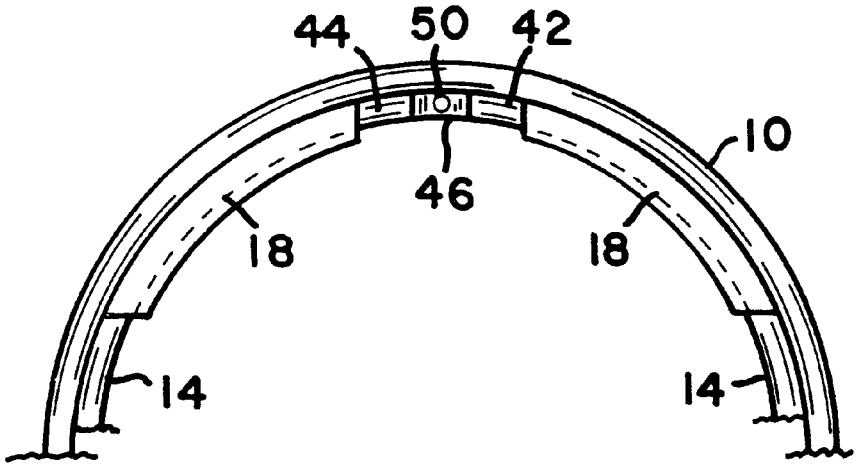
FIG. 9
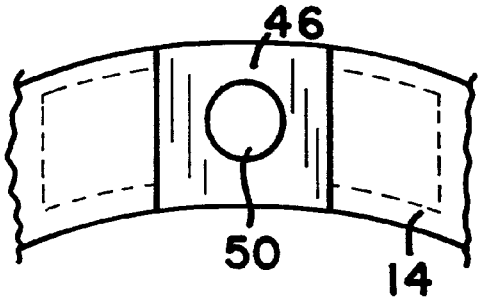
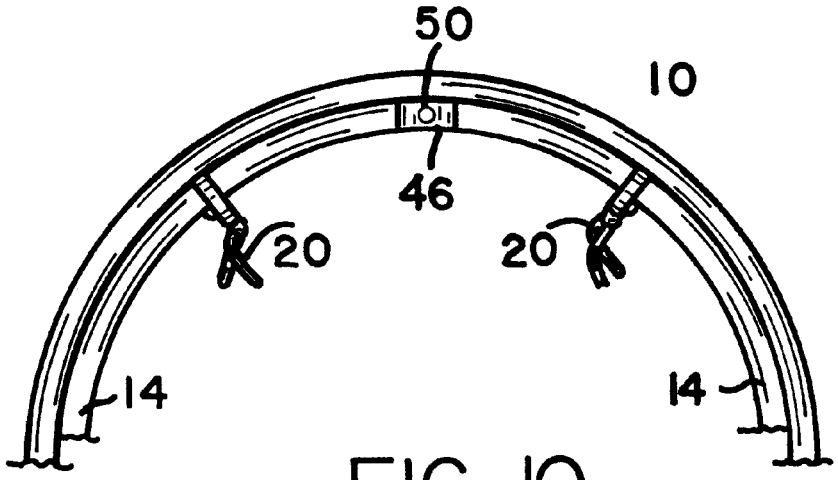
FIG. 10

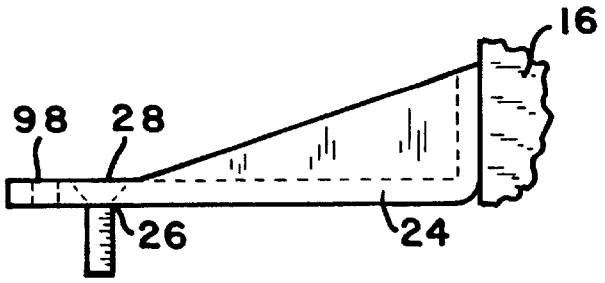
FIG. 11
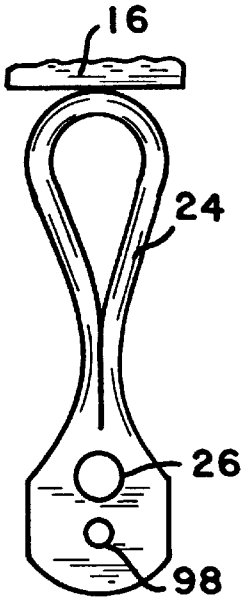
FIG. 12
FIG. 13
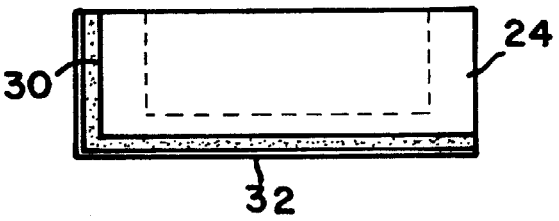
FIG. 14
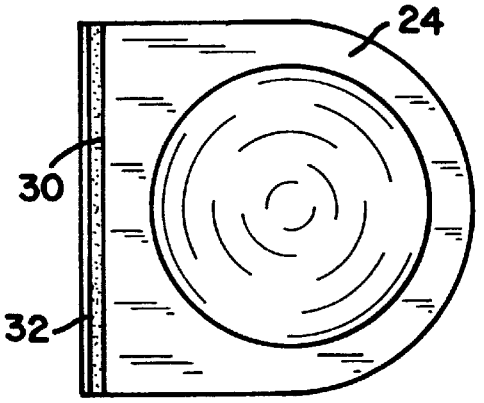

ACCESSORY COVER FOR A BOAT

The present invention relates to boat covers or the like, but more particularly relates to an accessory item that is removably attachable to a boat to form a cover usable as a tent, with the accessory being foldable, universal, adjustable and completely portable.

BACKGROUND OF THE INVENTION

Boat covers to provide shelter are well known within the prior art and are most often used to protect the boat itself, or are limited to use as a hunting blind. The known prior art that are suitable for camping, or covering the boater are much too complicated, and do not allow the boater to easily stand within the boat when attached, such as taught within the present invention.

Examples of such prior art are taught within U.S. Pat. Nos. 5,458,079, 5,303,667 and 4,300,253. Unfortunately, these covers are difficult to assemble, are very bulky and limited in use.

Taught within U.S. Pat. No. 4,075,723, they provide a cover which uses a flexible resilient rib, however, only one rib is taught, whereas the present invention utilizes multiple ribs which provide increased usable space, as well as increased strength. Another example of prior art is U.S. Pat. No. 4,671,203, which teaches a camouflaged cover having complicated adjustable frames and is limited to use as a duck blind.

In addition, nowhere in the prior art did the applicants find an accessory cover which includes a tie-down, such as a bungee cord or the like, which allows the cover to be easily adjustable and fit boats of various sizes. Furthermore, nowhere in the prior art did the applicants find use of a slip lock to assure a tight fit around the entire diameter of the boat, as taught within the present invention.

The attachment means used to attach the frames or ribs to the cover as taught within the prior art, are complicated and involve many unnecessary parts, which the present invention eliminates.

The present invention addresses and resolves the problems associated with the prior art, such as we provide simplified fiberglass tent ribs which are easily inserted within rib pockets, with the pockets being strategically placed to hold the rib. The pocket is mounted using one screw only or adhesive and eliminates the need for complex type attachment means, such as found within the prior art.

SUMMARY OF THE INVENTION

It is therefore an object of the present invention to provide an accessory cover device for a boat which is of simple construction, easily assembled, completely portable, and allows a user to comfortably camp within their boat.

Yet another object of the present invention is to provide an accessory cover device for a boat which includes multiple support ribs which are easily installed or removed.

Also a very important object of the present invention is to provide an accessory cover device for a boat which will not damage or mar the boat in any manner.

Still a further object of the present invention is to provide an accessory cover device for a boat which will protect the boat and occupants from the weather. As the cover is made from substantially a water-proof material.

Also another object of the present invention is to provide an accessory cover device for a boat which may include petitioned areas for privacy of the user, and/or the cover may include a window, or door, etc.

Still a further object of the present invention is to provide an accessory cover device for a boat having an adjustable bungee cord or the like, which may be adjustably held in place by multiple slip locks.

Also another object of the present invention is to provide suction cups if so desired, which are used to further secure the cover onto the boat.

Yet another object of the present invention is to provide an accessory cover device for a boat which may include color coding for easy assembly of the cover and ribs.

Also another object of the present invention is to provide an accessory cover device for a boat which when folded, may be easily stored and/or transported within a convenient carrying case. With the case being specifically designed with compartments for receiving the various components for the cover.

Yet another object of the present invention is to provide an accessory cover device for a boat which is adjustably attached to substantially the gunnel and rub rail, such as typically found on most bass boats, or the like.

Also another object of the present invention is to provide an accessory cover device for a boat which may include an inflatable mattress which is contained within the cover.

Still a further object of the present invention is to provide an accessory cover device for a boat which includes multiple ribs, and we teach multiple embodiments for forming each of the ribs. For example, the ribs may be formed from interconnected shock cords, multiple members which are frictionally interconnected, or still further they may be interconnected by a suitable attachment member.

Also another object of the present invention is to provide an accessory cover device for a boat which may be pretreated with insect repellent at the point of manufacture.

Other objects and advantages will be seen when taken into consideration with the following specification and drawings.

BRIEF DESCRIPTION OF THE DRAWINGS

FIG. 8 is substantially a partial plan view showing a rib when attached by multiple rib sleeves.

FIG. 9 is substantially a partial plan view of a removable insert member, drawn to a different scale, for removably attaching multiple rib members together.

FIG. 10 is substantially a partial plan view showing a rib when attached by multiple tie straps.

FIG. 11 is substantially a side view showing one embodiment for a rib pocket.

FIG. 12 is substantially a top view of FIG. 11.

FIG. 13 is substantially a side view showing a second embodiment for a rib pocket.

FIG. 14 is substantially a top view of FIG. 13.

DETAILED DESCRIPTION OF THE DRAWINGS

Figure 1:
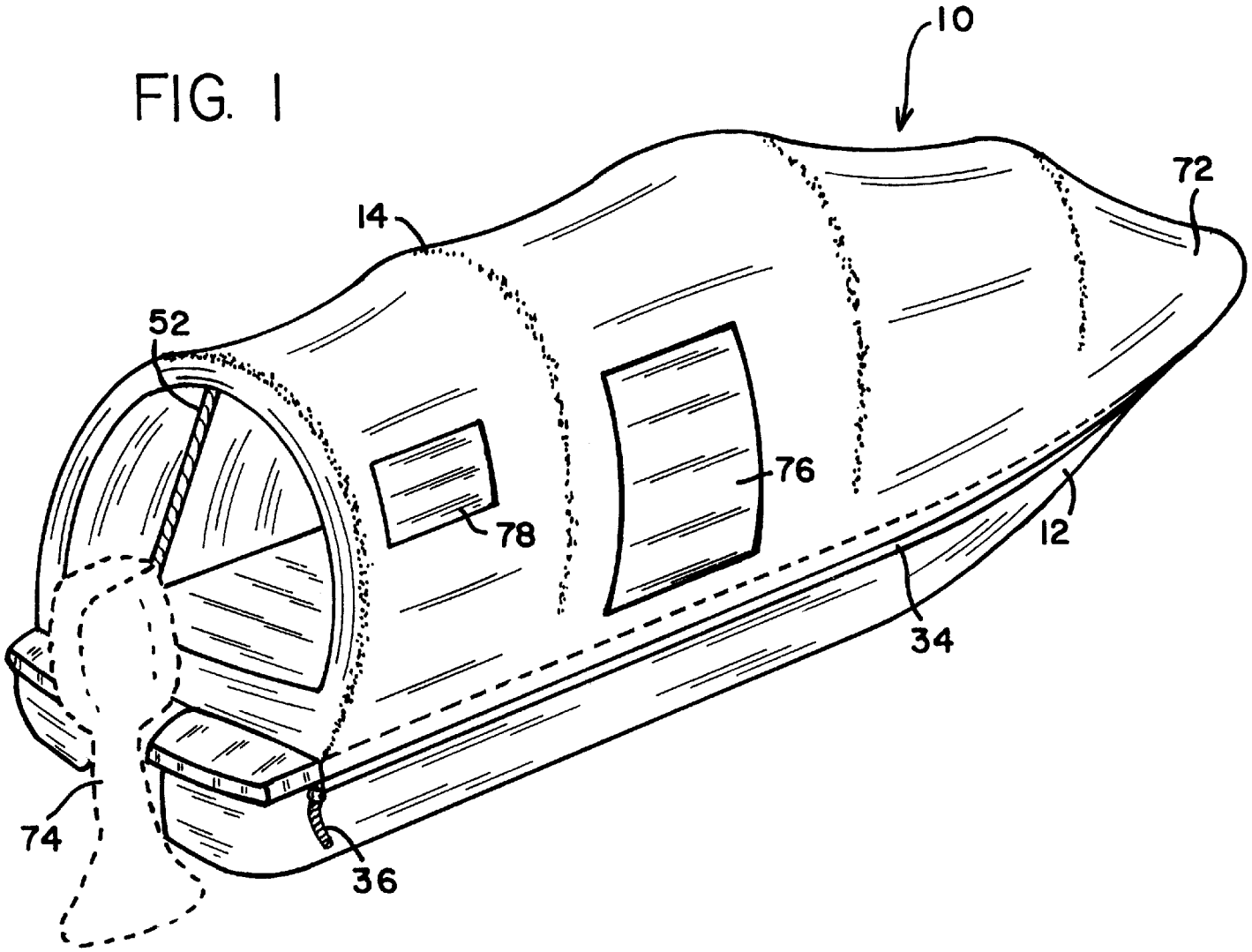
FIG. 1 is substantially an overview of the present invention showing the preferred embodiment.
Figure 2:
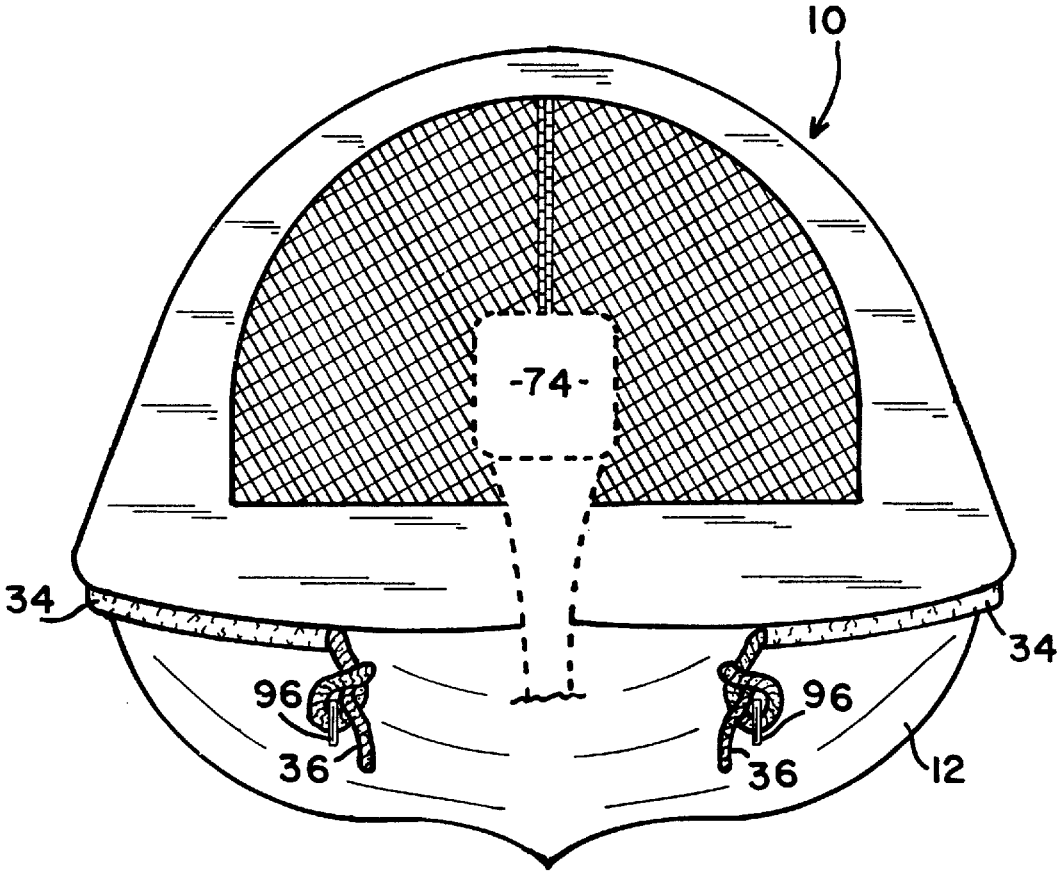
FIG. 2 is substantially an end view of the present invention when assembled and attached to a boat.

Referring now in detail to the drawings wherein like characters refer to like elements throughout the various views.

Throughout the drawings (arrow 10) represents an overview of the present invention which is substantially an accessory cover device that is removably attachable to an open-top boat (12). Thus, when the accessory cover device (arrow 10) is positioned and attached to boat (12), the accessory cover device (arrow 10) and boat (12) cooperate together to form an interior compartment which is of a shape and size to provide comfortable shelter for a user. Whereby, the user can easily assemble accessory cover device (arrow 10) upon boat (12) even while the boater is out on the water. Or if preferred, the accessory cover device (arrow 10) can be assembled and attached to boat (12) while on the shore, and can easily be used for camping either while on the water, or while on land.

Referring now to accessory cover device (arrow 10) which is formed from a flexible cover (11) made from substantially any suitable material of engineering choice, such as Vinyl, canvass, plastic, Nylon, etc, or any other material which may be water-proof.

Flexible cover Novice (11) is substantially of a length to extend from the bow to the stern of boat (12), and is of a width longer than the distance between the port and starboard of boat (12). However, any other suitable shape or size may be produced, depending on engineering choice.

Flexible cover (11) further includes multiple spaced apart ribs (14), which are removably positioned substantially between the existing opposing gunnels (16) as typically found on most boats, such as on bass boats, or the like.

Flexible cover (11) also includes attachment means thereon for securing ribs (14) within the flexible cover (11), and flexible cover (11) further includes attachment means for removably attaching flexible cover (11) to the boat (12). Thus, both the noted attachment means are defined and clarified within the following specification.

It is to be noted various types of attachment means of engineering choice may be used for securing ribs (14) within the flexible cover (11). However, the applicants have found the following embodiments to be most efficient. For example, as illustrated within FIG. 8, we show flexible cover (11) having multiple rib sleeves (18) formed and attached within the interior compartment of flexible cover (11), with each of the sleeves (18) being of a shape and size to slidably receive and retain ribs (14) therein. It is to be understood each of the rib sleeves (18) may be formed by any suitable means of engineering choice, such as the sleeves (18) may be sewn in place, or the like. It is to be further understood any amount of sleeves (18) may be used according to engineering choice, such as two for each of the multiple ribs (14), etc.

A second embodiment for attaching multiple ribs (14) within flexible cover (11) is illustrated within FIG. 10, wherein flexible cover (11) includes multiple tie straps (20). It is to be noted that any suitable tie straps may be used of engineering choice. For example, tie straps (20) may be formed from Nylon, plastic, etc., and each of the tie straps include substantially a central section which is fixedly attached, such as by stitching (not shown) at a location of choice within flexible cover (11), with each of the straps (20) being of a length to be easily wrapped then tied around the circumference of one of the ribs (14).

Figure 4:
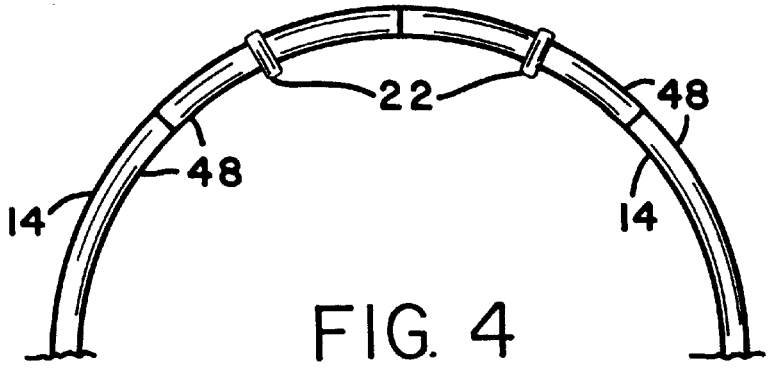
FIG. 4 is substantially a partial plan view showing the preferred embodiment for assembling a rib, comprised of multiple interconnected shock cords.
Figure 5:
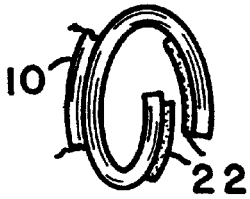
FIG. 5 is substantially a side view of a VELCRO strap used to secure the rib members.

A third embodiment for attaching multiple ribs (14) within flexible cover (11) is illustrated within FIGS. 4 & 5, wherein flexible cover (11) includes multiple VELCRO straps (22) each of which are of a length to be easily wrapped then folded around the circumference of one of ribs (14).

It is to be noted that attachment means for securing ribs (14) within flexible cover (11) further includes multiple rib pockets (24). It is to be understood each of the rib pockets (24) may be any suitable rib pocket of engineering choice. For example, in FIGS. 11 & 12, we show one embodiment wherein rib pockets (24) are formed from a piece of material which is sewn and folded into the proper configuration to form a pocket, and each of the rib pocket (24) includes attachment means thereon for removably attaching each of the rib pockets (24) to one of the gunnels (16). For example, rib pockets (24) may be attached by a hole (26) formed within pockets (24) and a threaded screw (28) is then inserted into hole (26) on each of the rib pockets (24).

In FIGS. 13 & 14 we show another embodiment for rib pockets (24) wherein each of the rib pockets (24) are in the shape of substantially a cup having a flat side (30) for engagement with gunnels (16), and a removable adhesive strip (32) attached to each of the rib pockets (24). Thus, each of the rib pockets (24) can be attached to gunnels (16) by either a threaded screw (28) or by adhesive (32).

Referring now to cover (arrow 10) which includes attachment means for removably attaching flexible cover (11) to boat (12) as previously noted. It is to be noted any suitable attachment means of engineering choice may be used. However, the applicants have found the following to be most efficient. For example, flexible cover (11) includes a sleeve (34) which is substantially of a shape and size to slidably retain a resilient flexible cord (36) therein, with the cord (36) being of a length longer than the entire exterior surface of boat (12) and which is secured in place substantially beneath the rub rail (38) on boat (12).

It is to be noted that if additional attachment means for removably attaching flexible cover (11) to boat (12) multiple suction cups (40) may be used. Thus, when flexible cover (11) is positioned and secured in place by cord (36), cups (40) may then be substantially pressed against the exterior edge of boat (12), which provides additional attachment means.

Referring now to each of the multiple ribs (14) which may be formed by any suitable means of engineering choice, and the following are examples of the various embodiments for different types of ribs (14).

In FIG. 4, we show the preferred embodiment for each of the multiple ribs (14), wherein we show each of the ribs (14) being formed from multiple interconnected shock cords (48). It is to be noted that description of the shock cords is not disclosed herein because shock cords are known and taught within the prior art. However, no where in the prior art did the applicants find a rib formed by such shock cords which would be suitable or efficient for the present use.

In FIG. 8 we show another embodiment for forming each of the multiple ribs (14), wherein we provide a right side member (42) and a left side member (44) with each member having attachment means for removably attaching each member (42 & 44) together, and each member (42 & 44) when interconnected forms substantially a half circle when assembled. Any suitable attachment means may be used of engineering choice. For example, in FIGS. 8 & 9, we show a removable insert member (46) which is made from substantially any suitable material of choice, such as rubber, plastic, or the like, and which is of a shape and size to be inserted and frictionally retained between the ends of each member (42 & 44), thus attaching members (42 & 44) together in a secure manner. Furthermore, if so desired insert (46) may further include a hole (50) there through, which may be used to attach a rope (52) thereon.

Figure 6:
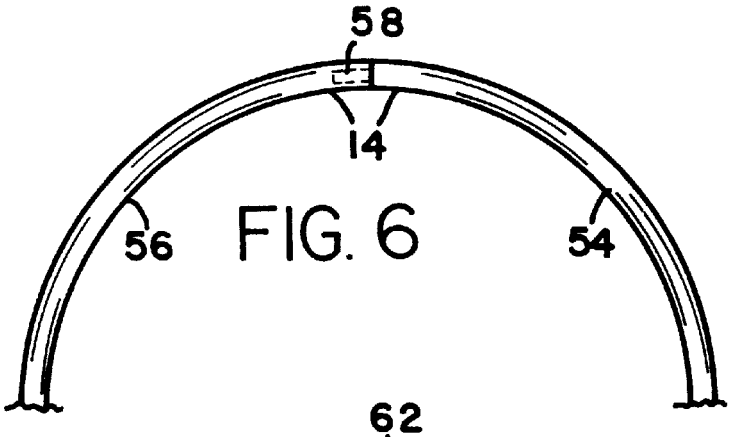
FIG. 6 is substantially a partial plan view showing a second embodiment for assembling a rib, comprised of multiple interconnected members.

Referring now to FIG. 6, wherein we show another embodiment for forming multiple ribs (14). As clearly shown therein, we provide a right side member (54) and a left side hollow member (56), and each member having a first end and a second end, with the second end of right side member (54) having a protrusion (58) thereon which is of a shape and size to be frictionally retained within the second end of left side member (56). Thus, members (54 & 56) are removably attached together, and when interconnected members (54 & 56) substantially form a half circle when assembled.

Figure 7:
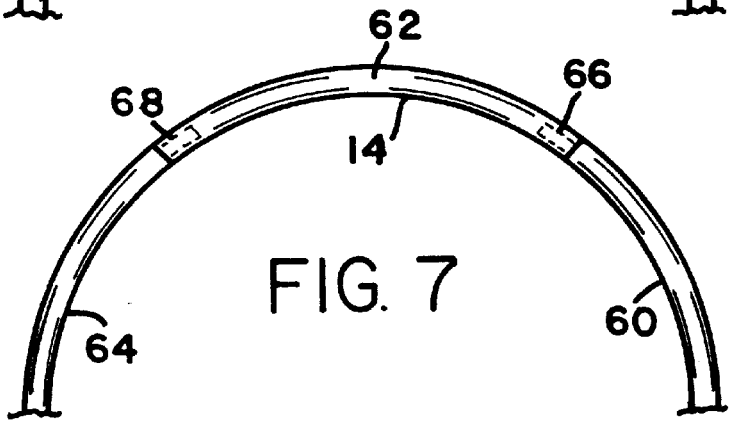
FIG. 7 is substantially a partial plan view showing a third embodiment for assembling a rib, comprised of multiple interconnected members.

In FIG. 7 we show yet another embodiment which is substantially similar to the above described embodiment however we now include a right member (60), a hollow central member (62) and a left side member (64). With each member having attachment means for removably attaching each of the members (60, 62 & 64) together and when each of the members are interconnected they substantially form a half circle when assembled. Each of the members (60, 62, & 64) have a first end and a second end, with the second end of right side member (60) having a protrusion (66) thereon which of a shape and size to be frictionally retained within the first end of central member (62), and the second end of left side member having a protrusion (68) thereon which is of a shape and size to be frictionally retained within the second end of central member (62).

Figure 15:
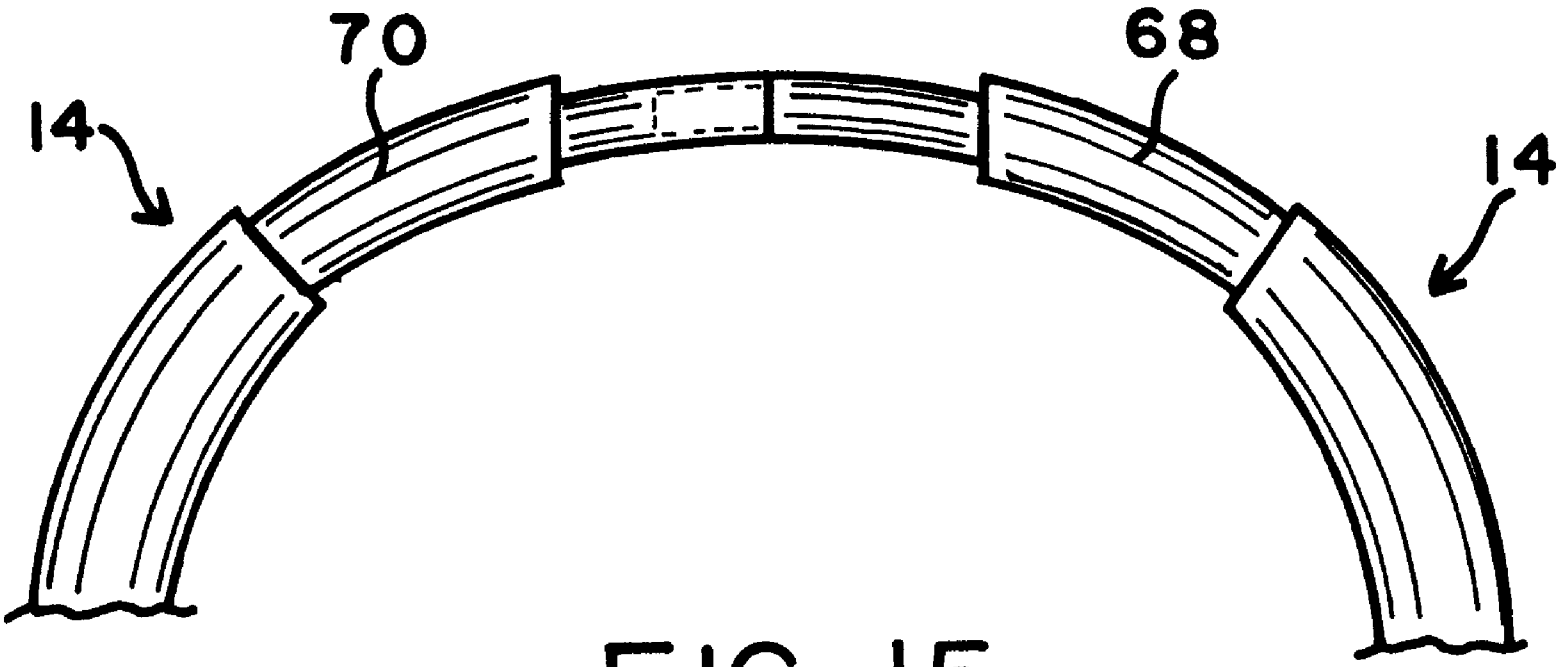
FIG. 15 is substantially a side view showing another embodiment for forming each of the multiple ribs.
Figure 16:
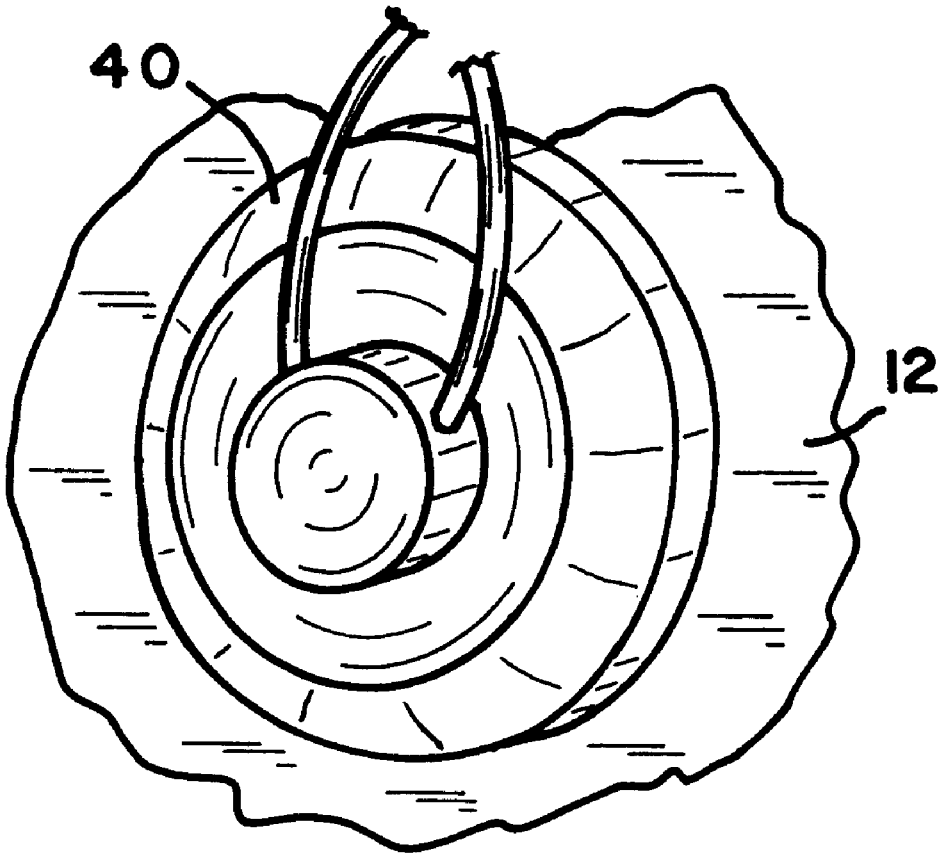
FIG. 16 is a partial view showing a suction cup attached to the cover member.

Another embodiment for each of the multiple ribs is illustrated within FIG. 15, wherein we show the multiple ribs (14) being formed from a right side member (68) and a left side member (70), however each of the members (68 & 70) are formed from multiple interconnected telescopic hollow sections, and each of the members (68 & 70) have a first end and a second end. With the first end of the right side member (68) being of a shape and size to be slidably engaged within one of the multiple rib pockets (24), and the second end of right side member (68) having attachment means for removably attaching the second end of the right side member (68) to the second end of the left side member (70). It is to be noted that any suitable attachment means of engineering choice may be used to removably attach the second end of the right side member (68) to the second end of the left side member (70). For example, the attachment means previously described, namely the removable insert member (46), is most suitable and very efficient.

Referring to accessory cover device (arrow 10), it is to be understood that if so desired flexible cover (11) may be shaped into a form which creates substantially a bow pocket (72), for slidably receiving a portion of the bow therein, thus further attaching flexible cover (11) to the bow of boat (12).

As depicted in FIG. 1, we further provide flexible cover (11) with an elongated rope (52) having a first end and a second end, with the first end being removably attached to one of the multiple ribs (14), with the second end being removably adjustably fastened to a motor (74) on boat (12. Thus, when rope (52) is manually pulled, flexible cover (11) and rope (52) cooperate together to apply tension to each of the multiple ribs (14) further causing ribs and flexible cover (11) to assume an upright position, and ribs (14) and flexible cover (11) remain in the upright position when the second end of rope (52) is fastened at a location of choice on motor (74).

Further illustrated in FIG. 1, we show flexible cover (11) having at least a door opening (76) which is of a shape and size to allow a user to easily enter or exit flexible cover (11).

Still further illustrated in FIG. 1, we show flexible cover (11) having at least one window opening (78) which is not only functional for ventilation purposes but also allows the occupants within accessory cover device (arrow 10) to fish while remaining under cover from the elements.

Figure 17:
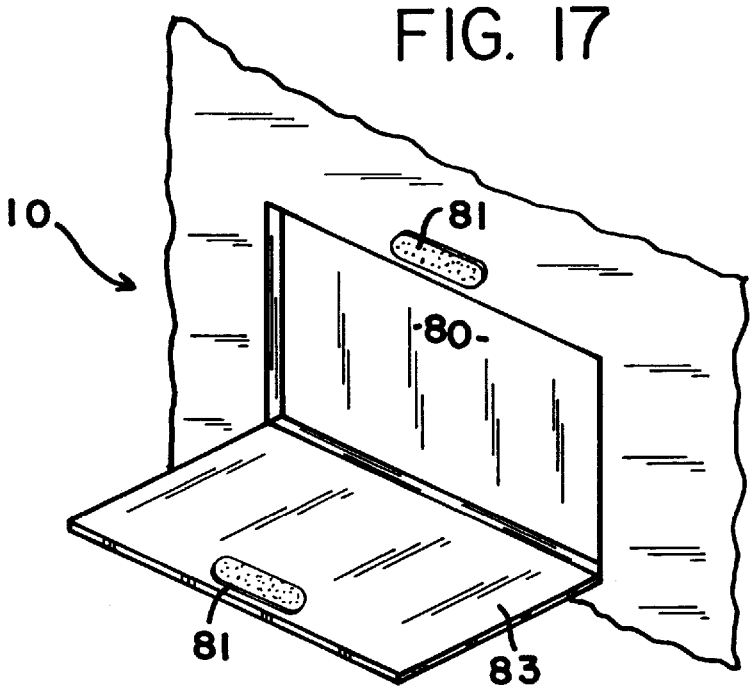
FIG. 17 is substantially a partial view showing a compartment formed within the cover member.
Figure 18:
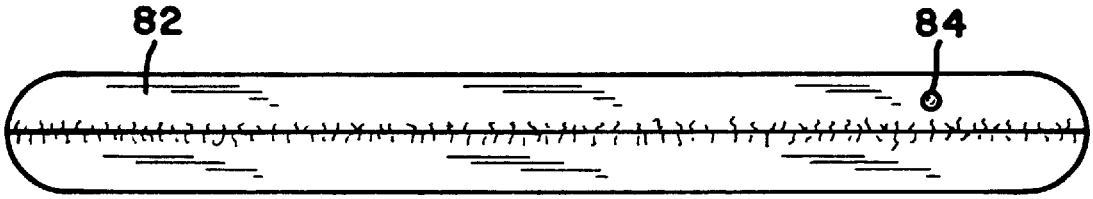
FIG. 18 is substantially a side view of a mattress.

Referring now to FIGS. 17 & 18 wherein we show flexible cover (11) having a compartment (80) formed therein, which is of a shape and size to contain a mattress (82) therein. Furthermore, compartment (80) includes a door (83) having fastener means thereon for holding door (83) in a closed position. It is to be noted any suitable fastener means of choice may be used, such as a loop and pile fastener, namely VELCRO (81), or the like.

It is to be understood that mattress (82) can be any suitable type of mattress of choice, such as an inflatable air mattress, or the mattress may be filled with water, forming substantially a waterbed. The last noted is most efficient because the user can easily fill the mattress through the fill hole (84) with the existing water surrounding the boat. Fill instructions and the means to close or open hole (84) is not included herewith as this is known and taught within the prior art.

Figure 3:
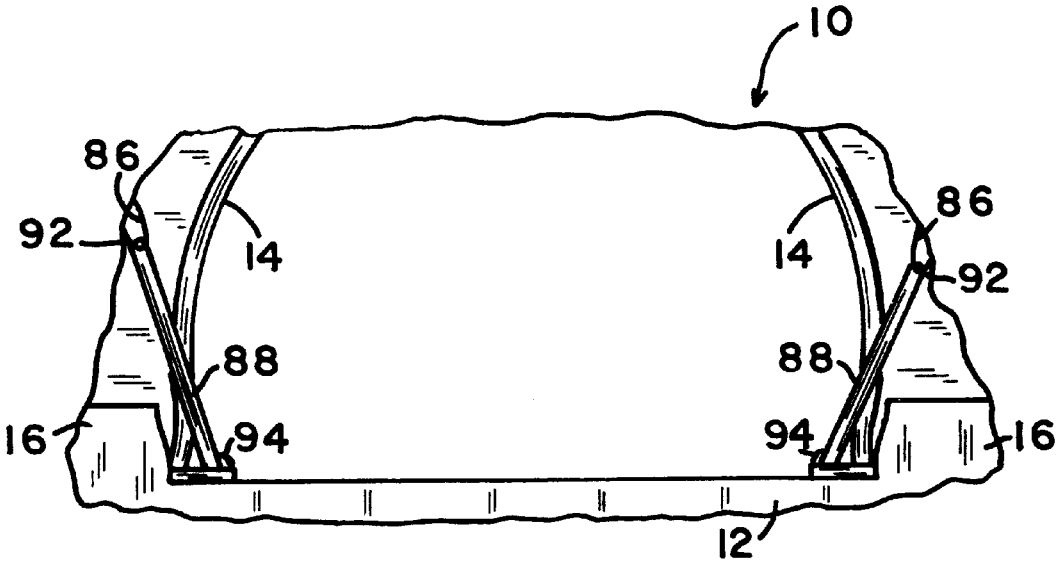
FIG. 3 is substantially a partial plan view of the present invention.

Further illustrated in FIG. 3, we flexible cover (11) having multiple exterior loops (86) thereon and multiple flexible resilient cords (88) each of which have a first end and a second end, with each first end having a first hook (92) and each second end having a second hook (94). With each first hook (92) being of a shape and size to be inserted and attached to one of the loops (86) and each second hook (94) being of a shape and size to be inserted and attached to one of the transom eyes (96) typically found on boat (12). Or if preferred, each second hook (94) may be inserted into a hole (98) located on each of the rib pockets (24). Thus, further securing flexible cover (11) onto boat (12).

It is to be understood that cord (36) may be fastened and secured by any suitable means of choice. For example, cord (36) may have each of its ends being simply manually tied at a location of choice.

It is to be also noted that each of the multiple ribs (14) and the attachment means for securing ribs within cover (arrow 10), if so desired may be color coded for easy assembly.

Although the invention has been herein shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus's.

Having described our invention, what we claim as new and desire to secure by Letters Patent is:

1. In combination with an open-top boat, an accessory cover device comprising: a flexible cover having a length to extend from the bow to the stern of said boat and a width longer than the distance between the port and starboard of said boat, said flexible cover having multiple spaced apart ribs removably positioned between the opposing gunnels of said boat, said flexible cover having attachment means thereon for securing said ribs within said flexible cover, said flexible cover having attachment means for removably attaching said flexible cover to said boat, said flexible cover having an elongated rope having a first end and a second end, said first end being removably attached to one of said ribs, and said second end being removably adjustably fastened to a motor on said boat, whereby;

when said rope is manually pulled, said flexible cover and said rope cooperate together to apply tension to each said multiple ribs which causes said ribs to assume an upright position, and said ribs remain in said upright position when said second end of said rope is fastened at a location of choice on said motor.

* * * * *